US007255611B2

(12) United States Patent
Kubo et al.

(10) Patent No.: US 7,255,611 B2
(45) Date of Patent: Aug. 14, 2007

(54) CONNECTOR

(75) Inventors: Tsukasa Kubo, Aichi (JP); Toshiaki Horii, Aichi (JP); Eiji Takeda, Aichi (JP)

(73) Assignee: J.S.T. Mfg. Co., Ltd., Osaka (JP)

( * ) Notice: Subject to any disclaimer, the term of this patent is extended or adjusted under 35 U.S.C. 154(b) by 0 days.

(21) Appl. No.: 11/060,617

(22) Filed: Feb. 18, 2005

(65) Prior Publication Data

US 2005/0202730 A1 Sep. 15, 2005

(30) Foreign Application Priority Data

Mar. 12, 2004 (JP) ..... 2004-071578

(51) Int. Cl.
*H01R 13/432* (2006.01)

(52) U.S. Cl. ..... 439/748

(58) Field of Classification Search ..... 439/745–748, 439/752.5, 839

See application file for complete search history.

(56) References Cited

U.S. PATENT DOCUMENTS

| | | | | |
|---|---|---|---|---|
| 4,824,404 | A * | 4/1989 | Bullard | 439/752 |
| 5,695,368 | A * | 12/1997 | Joly et al. | 439/748 |
| 6,183,312 | B1 * | 2/2001 | Yamamoto | 439/748 |
| 6,204,065 | B1 * | 3/2001 | Ochiai | 436/66 |
| 7,056,158 | B2 * | 6/2006 | Kuroda et al. | 439/748 |

FOREIGN PATENT DOCUMENTS

| | | | |
|---|---|---|---|
| JP | 5-290917 | A | 11/1993 |
| JP | 6-325818 | A | 11/1994 |
| JP | 7-240247 | A | 9/1995 |
| JP | 7-296876 | A | 11/1995 |
| JP | 7-296878 | A | 11/1995 |
| JP | 9-92367 | A | 4/1997 |
| JP | 9-92368 | A | 4/1997 |
| JP | 2001-332334 | A | 11/2001 |
| JP | 2003-59573 | A | 2/2003 |
| JP | 2004-22482 | A | 1/2004 |

* cited by examiner

*Primary Examiner*—Alexander Gilman
(74) *Attorney, Agent, or Firm*—Rader, Fishman & Grauer PLLC

(57) ABSTRACT

A connector having a compact engagement structure providing a high retaining force is provided. A shoulder is provided on an inner wall of a housing for storing a contact. The shoulder is inclined so that a distal end thereof projects toward a first end of the housing with respect to a proximal end thereof. An engaging piece which engages the shoulder is provided on an engaging portion of a contact body. An inner edge of a distal end of the engaging piece is chamfered. The contact is inserted into a storage chamber of the housing from a second end of the housing, and the engaging piece smoothly lifts from the distal end of the shoulder to the proximal end. Accordingly, the contact is retained by the housing with a high retaining force.

19 Claims, 8 Drawing Sheets

CONNECTOR

CROSS-REFERENCE TO RELATED APPLICATIONS

This application is based upon and claims the benefit of priority from Japanese Patent application No. 2004-071578 filed on Mar. 12, 2004, the entire contents of which is incorporated herein by reference.

FIELD OF THE INVENTION

The present invention relates to a connector including a contact provided with an engaging piece to be engaged with a shoulder formed on the inner wall of a housing so as to be retained in the housing.

RELATED ART

In the related art, a connector having a contact provided with a contact portion that comes into contact with a contact of an opposite connector and a housing for retaining the contact is known as a connector for connecting electric equipment. In such a connector, a contact body formed of conductive material such as a metal plate is fixed to the end of an electric cable covered by an insulating material, and is retained in the insulative housing. The contact body is provided with an engaging piece projecting from the contact body and, on the other hand, the housing is provided with a shoulder (or "engaging wall") for engaging the engaging piece. With the engaging piece and the engaging wall, the contact inserted into the housing cannot be pulled out from the housing even when the electric cable is pulled.

As an engagement structure between the contact and the housing, it is required to be capable of reducing a force needed to insert the contact into the housing, and of achieving a high retaining force for the contact inserted into the housing. In particular, in view of downsizing of electronic equipment in these years, the engagement structure is also required to be downsized. Therefore, a contact which is provided with an engaging piece which can increase a retaining force with a compact structure is proposed in JP-A-2004-22482 (Patent Document 1).

The engaging piece of the contact disclosed in Patent Document 1 has a high rigidity because it is formed by punching out a metal plate from a basal plate and includes a wide portion having a width substantially the same width as the lateral width of the basal plate. On the other hand, the engaging piece has a high resiliency since it is bent at two points of proximal end and a midsection. In this manner, the engaging piece of the contact disclosed in Patent Document 1 is improved in the retaining force by increasing its rigidity and resiliency.

However, since the engaging piece of the contact disclosed in Patent Document 1 is bent at two positions, the structure is complex and the manufacturing process becomes also complex. Since the engaging piece is bent at the midsection, the length of the engaging piece required for lifting the engaging piece to a predetermined height increases in comparison with the case of not bending at the midsection, which may lead to upsizing of the contact.

On the other hand, when the engaging piece is lifted by inclining the same linearly from the proximal end to the distal end without bending, the angular portion at the distal end comes into contact with the engaging wall. Therefore, the contact area between the engaging piece and the engaging wall decreases and the retaining force also decreases correspondingly. Also, since the angular portion at the distal end of the engaging piece moves in a state of being in contact with the engaging wall, the engaging wall may be chipped off. In particular, when the contact body including the engaging piece is formed by hard metal in order to cope with the usage under severe conditions such as high temperature, the engaging wall is chipped off by the engaging piece and deterioration of the retaining force may be resulted.

SUMMARY OF THE INVENTION

In view of such a problem described above, it is an object of the present invention to provide a connector which is provided with a compact engagement structure providing a high retaining force. More specifically it is an object of the present invention to provide a connector in which deterioration of the retaining force caused by chipping off of an engaging wall by an engaging piece is prevented even when a contact body is formed of hard metal for enabling usage under severe conditions such as high temperature.

In order to solve the above-described problems, the followings will be provided.

(1) A connector including: a cylindrical housing including a first end formed with a first opening, a second end opposing to the first end and being formed with a second opening, and a storage chamber formed between the first end and the second end; a contact body inserted from the second end of the housing and stored in the storage chamber; and an electric cable connected to the contact body and extending from the second end of the housing, the connector to be fitted to an opposite connector inserted from the first end of the housing, wherein the contact body including a contact portion which comes into contact with a contact of the opposite connector, a crimp terminated portion for crimp terminating the end of the electric cable, and an engaging portion provided between the crimp terminated portion and the contact portion; the engaging portion including an engaging plate extending in parallel with the direction of insertion of the contact body, and an engaging piece connected to the engaging plate and being resiliently deformable, the engaging piece is inclined from the proximal end to the distal end in such a manner that the distal end lifts from the engaging plate, the storage chamber is provided with an inner wall opposing to the engaging plate, and the inner wall is formed with a shoulder for engaging the engaging piece, the shoulder is inclined from the proximal end to the distal end and the distal end thereof projects toward the first end of the housing.

According to the invention as described in (1), the shoulder formed on the inner wall of the housing is inclined so as to form an inverted tapered shape, and the distal end of the shoulder is protruded from the proximal end thereof toward the first end of the housing. The contact body is inserted from the second end of the housing toward the first end, and the shoulder serves as an engaging wall which the engaging piece engages with. The first end may be referred to as "front end" and the second end may be referred to as "rear end" hereinafter.

With the provision of the shoulder of inverted tapered shape, even when the electric cable which is crimped to the contact body is pulled toward the rear end of the housing, the engaging piece of the contact body lifts smoothly from the distal end to the proximal end along the inclination of the shoulder, and is hardly comes off. The engaging piece lifted from the distal end to the proximal end of the shoulder is engaged at the position in the vicinity of the proximal end of the shoulder. When the engaging piece is engaged with the proximal portion, a force to pull the contact body is received by a wide portion of the shoulder, the engagement retaining force can be increased.

(2) A connector according to (1), wherein the engaging piece includes an inner surface opposing to the engaging plate, an outer surface extending in parallel with the inner surface and opposing to the inner wall, and a distal end surface connecting the inner surface and the outer surface at the distal end of the engaging piece, and a chamfered inner edge is formed between the distal end surface and the inner surface.

According to the invention described in (2), the inner edge at the distal end of the engaging piece is chamfered into a rounded smooth surface. Since the engaging piece is formed by cutting a sheet of metal plate in the direction perpendicular to the direction of extension of this plate, in the case of the engaging piece in the related art, the inner edge and an outer edge, which correspond to both edges of the cutting surface of the metal plate are both angulated. When such an engaging piece is lifted linearly from the proximal end to the distal end without bending, the engaging piece comes into contact with the shoulder at the angular inner edge, the engaging area is small, and hence the retaining force may be reduced. Also, the angular inner edge of the engaging piece serves as a cutting edge, and chips off the shoulder which is formed of synthetic resin or the like as the housing, whereby the retaining force may be deteriorated.

On the other hand, according to the invention described in (2), since the engaging area can be increased by chamfering the inner edge at the distal end of the engaging piece, the retaining force can be increased without bending the engaging piece or increasing the lifting height of the engaging piece. Also, since the shoulder can be prevented form being chipped off by the engaging piece, lowering of the retaining force can be prevented.

(3) A connector according to (1) or (2), wherein the engaging plate is formed with a projection at a position opposing to the engaging piece so as to project in the lifting direction of the engaging piece.

According to the invention described in (3), the projection is provided on the engaging plate opposing to the engaging piece, so that the engaging piece comes into contact with the projection when the engaging piece is pressed down toward the engaging plate. Therefore, even when the engaging piece is pressed down, the engaging piece can be maintained in a state of being lifted from the contact body. With the engaging piece maintained in a state of being lifted upward from the contact body, the state in which the distal end of the engaging piece is caught by the shoulder is maintained. Therefore, when the electric cable is pulled, the engaging piece which is caught by the distal end of the shoulder is lifted upward smoothly, whereby the contact is retained in the housing.

(4) A connector according to any one of (1) to (3), wherein the contact body is formed of titan-copper plate containing titan and copper.

According to the invention described in (4), the contact body is formed of a metal plate of titan-copper containing titan and copper. The titan-copper is superior in resiliency and hard material, and hence permanent strain of the engaging piece is prevented and the retaining force can be improved. In particular, the contact body including the engaging piece is formed of titan-copper plate, it is preferable to chamfer the inner edge of the distal end of the engaging piece in order to prevent the shoulder from chipping off. Since the titan-copper has a high stress-alleviating property even under the severe environment which increases in temperature, the connector including the titan-copper contact body can be used under the high-temperature environment such as a power source for a lamp.

In order to enable the connector to be used under the high-temperature environment, in addition to form the contact body of titan-copper, preferably, the housing is formed of material which has a long-term heat resistance property. Insulative material which is superior in long-term heat resistance property includes, for example, a polyphenylene sulfide resin (PPS resin) containing glass.

(5) A connector according to any one of (1) to (4), wherein the engaging piece is provided with a projected portion at a midsection between the proximal end and the distal end so as to project in the direction of lifting of the engaging piece.

According to the invention described in (5), by forming a projected portion at the midsection of the engaging piece so as to project in the direction in which the engaging piece is punched out and lifted up, a force generated by pulling the electric cable is dispersed on the inner wall portion which defines the housing storage chamber to enhance the retaining force between the contact and the housing.

(6) A connector according to any one of (1) to (5), wherein the contact portion includes a contact plate which comes into contact with the contact of the opposite connector, a contact spring opposing to the contact plate, and a side wall for connecting the contact spring and the contact plate, and an insertion port for press-fitting the contact of the opposite contact is formed between the contact plate and the contact spring.

According to the invention described in (6), a female connector including a contact ("socket contact") for clamping the opposite contact between the contact spring and the contact plate is provided with the engagement structure including the engaging piece and the engaging shoulder according to any one of (1) to (5) described above.

(7) A connector according to any one of (1) to (5), wherein the contact portion includes a contact plate which comes into contact with the contact of the opposite connector, and the contact plate comes into contact with the contact of the opposite connector by being press-fitted into the opposite contact.

According to the invention described in (7), a male connector having a tab type contact to be press-fitted into the opposite contact is provided with the engagement structure composed of the engaging piece and the shoulder according to any one of (1) to (5) described above.

(8) A method for manufacturing a contact including an engaging piece forming step for forming an engaging piece projecting from a contact body of the contact by cutting and bending part of a metal plate which constitutes the contact body, wherein punching the metal plate by a punch including a chamfering portion which comes into abutment with an inner edge at the distal end of the engaging piece and a retaining portion which comes into abutment with a midsection located between the proximal end and the distal end of the engaging piece, so as to chamfer the inner edge and form a projection at the midsection in the engaging piece forming step.

The engaging piece of the connector according to the invention described in (5) can be machined by chamfering the inner edge of the distal end of the engaging piece and forming the projection at the midsection of the engaging piece by machining the engaging piece using the punch having the chamfering portion and the retaining portion.

According to the invention, the engaging piece can be engaged smoothly with the inner wall of the housing without upsizing the engaging piece provided on the contact. Therefore, the engaging piece can be downsized and its retaining force can be increased. In particular, when the shoulder for engaging the engaging piece is formed into an inverted tapered shape, and the inner side of the distal end of the engaging piece is formed into a smooth surface, a high retaining force is obtained by a gradually lifting structure of the smooth surface along the inverted taper, and the shoulder is prevented from being chipped out by the engaging piece, whereby the high retaining force can be maintained.

BRIEF DESCRIPTION OF THE DRAWINGS

FIGS. 2A~2E show a socket contact body according to the embodiment, in which FIG. 2A is a plan view; FIG. 2B is a bottom view; FIG. 2C is a front view; FIG. 2D is a side view; and FIG. 2E is a cross-sectional taken along the line X-X in FIG. 2A;

FIGS. 3A~3E show a socket housing according to the present embodiment, in which FIG. 3A is a plan view; FIG. 3B is a side view; FIG. 3C is a front view, FIG. 3D is a back view, and FIG. 3E is a cross-sectional view taken along the line Y-Y in FIG. 3A;

FIGS. 4A and 4B are drawings showing a state in which the socket contact is inserted into the socket housing according to the embodiment, in which FIG. 4A is a cross-sectional view, and FIG. 4B is an enlarged view of the portion indicated by p;

FIGS. 5A~5C show a state of engagement between the socket contact according to the present embodiment and the socket housing, in which FIG. 5A shows a state in which the engaging piece is engaged with the shoulder at a position in the vicinity of the distal end;, FIG. 5B is a state in which the engaging piece pivots, and FIG. 5C is a state in which the engaging piece is engaged with the shoulder at a position in the vicinity of the proximal end;

FIG. 7B is an example in which the width of chamfer on the distal end surface is large, and FIG. 7C is an example in which the inner edge has an arcuate shape, and FIG. 7D is another example in which the inner edge has an arcuate shape.

FIGS. 8A~8F show a method of chamfering the inner edge of the engaging piece according to the invention, in which FIG. 8A shows a case of chamfering in the shape shown in the first embodiment, FIG. 8B shows a case of chamfering into the shape shown in FIG. 7B, FIG. 8C shows a case of chamfering into the shape shown in FIG. 7C, FIG. 8D shows a case of chamfering into the shape shown in FIG. 7D; FIG. 8E shows a process of lifting the engaging piece; and FIG. 8F shows a case of forming a projection on the engaging piece.

DESCRIPTION OF THE PREFERRED EMBODIMENT

Figure 1:
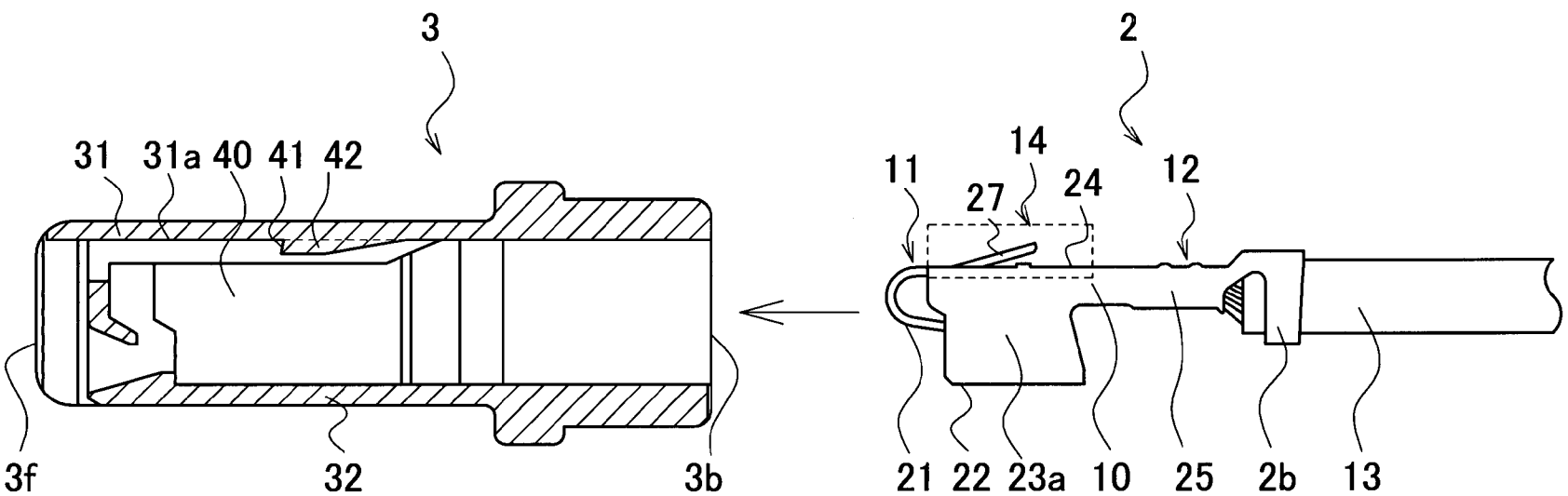
FIG. 1 is a drawing including a socket contact and a socket housing arranged so as to oppose to each other according to a first embodiment of the present invention.

Subsequently, referring to the drawings, embodiments of the present invention will be described below. The same parts are represented by the same reference numerals and description for the parts will be omitted or simplified, hereinafter.

FIG. 1 is a drawing showing a female connector 1 according to a first embodiment of the invention, which includes a contact of socket type ("socket contact") 2 and a housing for socket contact ("socket housing") 3 arranged so as to oppose to each other. The socket contact 2 includes an electric cable 13 and a socket contact body 10 connected to the end of the electric cable 13.

Figure 2A:
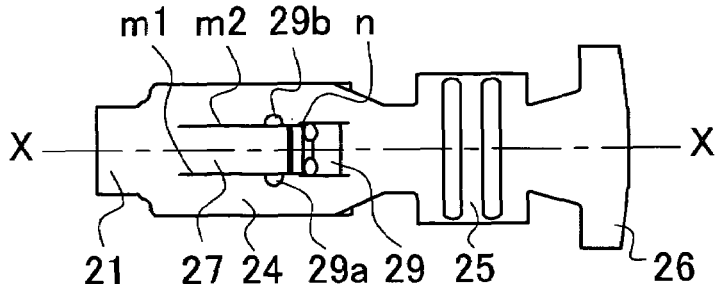
Figure 2B:
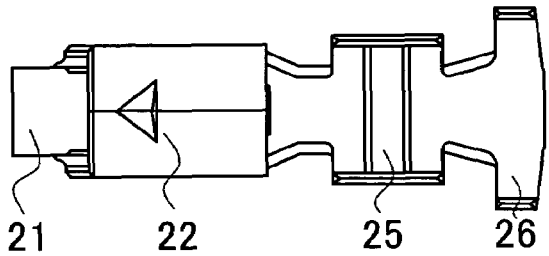
Figure 2C:
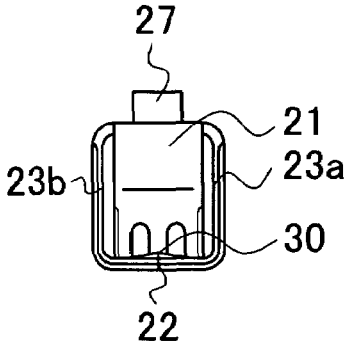
Figure 2D:
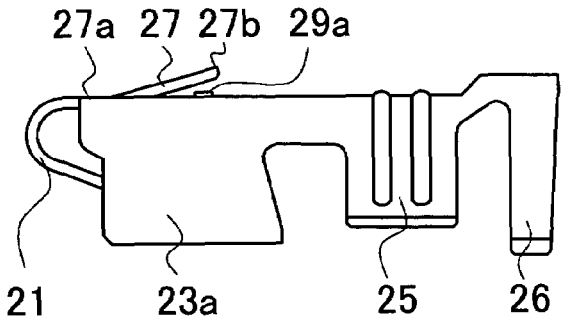
Figure 2E:
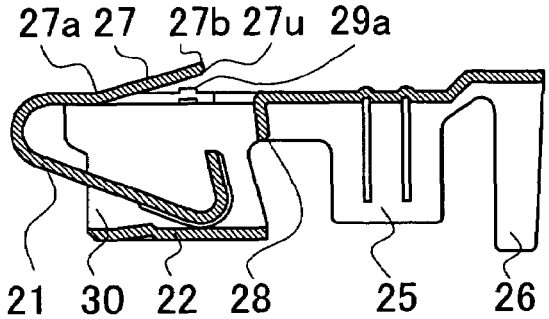

FIG. 2A is a plan view of the socket contact body 10; FIG. 2B is a bottom view; FIG. 2C is a front view; FIG. 2D is a side view; and FIG. 2E is a cross-sectional view showing a case in which the socket contact body 10 is cut along the line X-X in FIG. 2A. The socket contact body 10 includes a contact portion 11 which comes into contact with a contact (not shown) of an opposite male contact, a crimp terminated portion 12 for crimp terminating and retaining an electric cable 13, and an engaging portion 14 provided between the contact portion 11 and the crimp terminated portion 12.

The socket contact body 10 is formed of material which can be used under the high temperature condition of about 100 to 200° C. In particular, the socket contact body 10 is formed by cutting and bending a sheet of titan-copper metal plate. The titan-copper is hard material which is superior in resiliency and stress-alleviating property at a high temperature. Therefore, the connector provided with a contact of titan-copper can be used as a connector for a power source of a lamp.

The contact portion 11 of the socket connector body 10 includes a contact spring 21, a contact plate 22 provided at a position opposing to the contact spring 21, and a pair of opposing side walls 23*a*, 23*b* for connecting the contact spring 21 and the contact plate 22. The contact spring 21 is bent so that a metal plate curves toward the contact plate 22 and hence has a resiliency. Formed between the contact spring 21 and the contact plate 22 is an insertion port 30 for press-fitting the male contact of the opposite connector.

The crimp terminating portion 12 includes a conductor retaining member 25 for retaining a conductor at the end of the electric cable 13, and a jacket retaining member 26 for retaining the coated electric cable. Provided between the conductor retaining member 25 and the contact spring 21 is an engaging plate 24 constituting the engaging portion 14.

The metal plate constituting the engaging portion 14 is cut along two parallel notches m1, m2 which are substantially parallel with the direction of the length of the contact body (lateral direction of FIG. 2A), and a vertical notch n which is orthogonal to the parallel notches m1, m2. The side of the metal plate on which the contact spring 21 is provided (hereinafter referred to as "front side"), is bent upward so as to project from the socket contact body 10 to form an engaging piece 27 bounded by the vertical notch n.

The engaging piece 27 is formed of a metal plate having resiliency, and is bent upward so as to project from the socket contact body 10, thereby providing with resiliency, and being capable of resiliently deformed. Also, the side of the metal plate on which the crimp terminated portion 12 is provided (hereinafter referred to as "rear side"), is bent bounded by the vertical notch n substantially at a right angle toward the contact plate 22 to form a vertical wall 28.

By the engaging piece 27 and the vertical wall 28 formed by being bent, the engaging plate 24 is formed with a hole 29 of substantially rectangular shape. A pair of projections 29*a*, 29*b* is formed at positions on each side edges formed by two opposing parallel notches m1, m2 and constituting edges of the hole 29, and the projections 29*a* and 29*b* are opposing to the portion in the vicinity of a distal end 27*b* of the engaging piece 27. An inner edge 27*u* of the distal end 27*b* of the engaging piece 27 is a chamfered smooth surface, and not angulated.

Figure 3C:
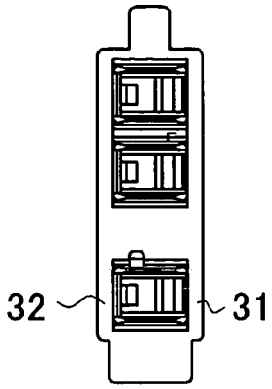
Figure 3A:
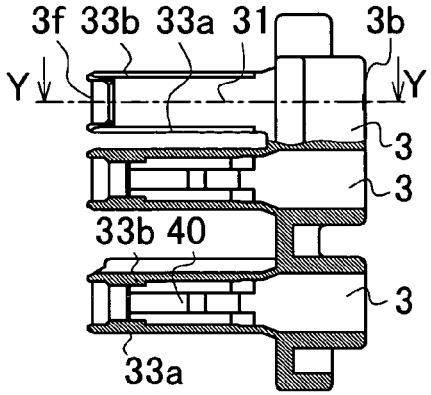
Figure 3D:
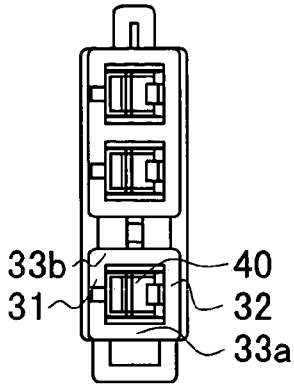
Figure 3B:
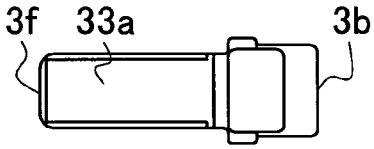
Figure 3E:
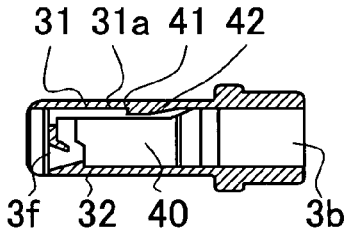

FIG. 3A is a plan view of the socket housing 3. In FIG. 3A, three socket housings 3 are connected in parallel, and two of them are shown in cross-section taken from a first end (or the "front end") 3*f* along a plane parallel with a second end (or "rear end") 3*b*. FIG. 3B is a side view of the socked housing 3 in FIG. 3A, FIG. 3C are a front view, FIG. 3D is a back view, FIG. 3E is a cross-sectional view of the socket housing 3 taken along the line Y-Y in FIG. 3A.

The socket housing 3 includes a first wall 31, a second wall 32 opposing to the first wall 31, and a pair of opposing side walls 33*a*, 33*b* connecting the first wall 31 and the second wall 32, and is formed substantially into the shape of a square tube. The socket housing 3 is formed with a storage chamber 40 surrounded by the first wall 31, the second wall 32, and the pair of the lateral walls 33*a*, 33*b*. The socket housing 3 is formed of PPS resin containing glass.

The front end 3*f* and the rear end 3*b* of the socket housing 3 are both opened, and each includes a first opening 4*f* and a second opening 4*b*. The socket contact 2 is inserted from the second opening 4*b* of the socket housing rear end 3*b* toward the storage chamber 40. On the other hand, the opposite contact is inserted into the storage chamber 40 from the first opening 4*f* at the front end 3*f* of the socket housing, and the opposite contact and the socket contact 2 are connected.

The first wall 31, the second wall 32, and the pair of the side walls 33*a*, 33*b* of the socket housing 3 cover the engaging plate 24, the contact plate 22, and the pair of the side walls 23*a*, 23*b* of the socket contact 2 respectively. One of the surfaces of the first wall 31 opposing to the engaging plate 24 defines the inner wall 31*a* of the storage chamber 40. The inner wall 31*a* is formed with an engaging protrusion 42 projecting in the direction orthogonal to the direction of insertion of the socket contact 2, and is formed with a shoulder 41 which functions as the engaging wall for engaging the engaging piece 27 with the end of the engaging protrusion 42.

Figure 4A:
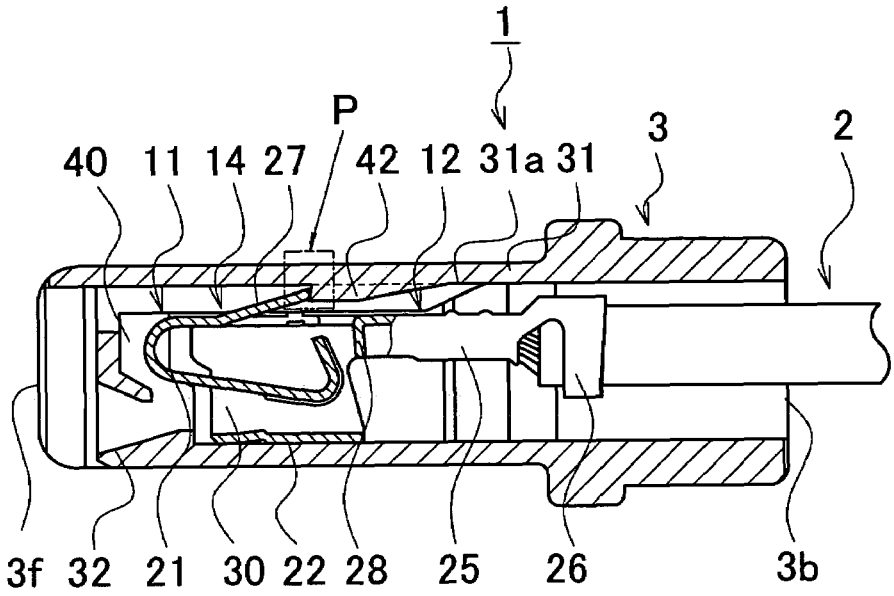
Figure 4B:
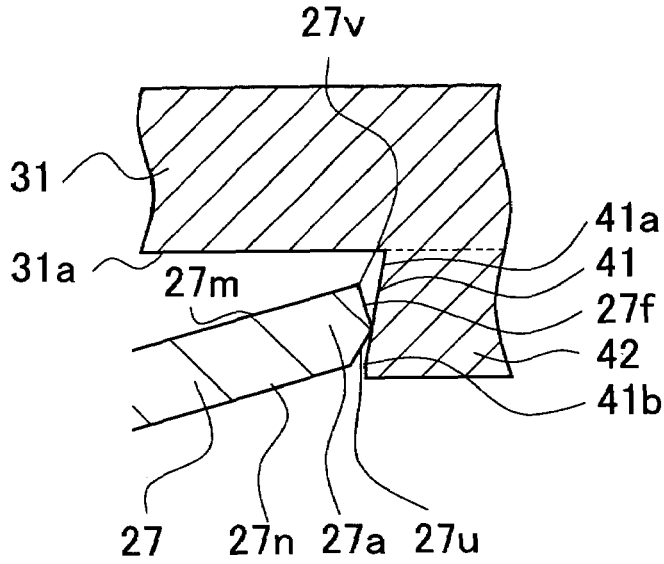

FIG. 4A is a cross-sectional view taken along the line Y-Y of FIG. 3A in a state in which the socket contact 2 is inserted into the socket housing 3. FIG. 4B is an enlarged view of the portion indicated by P in FIG. 4A, and showing an engagement structure between the socket contact 2 and the socket housing 3 by means of the shoulder 41 and the engaging piece 27.

The shoulder 41 has an inclined surface having a distal end 41*b* projecting with respect to a proximal end 41*a* toward the front end 3*f* of the socket housing. The engaging protrusion 42 is formed in such a manner that the height projecting from an inner wall 31*a* decreases gradually toward the rear end 3*b* of the socket housing. The socket contact 2 is inserted from the rear end 3*b* of the socket housing, and the engaging piece 27 having resiliency is lifted upward along the distal end 41*b* to the proximal end 41*a* of the shoulder 41, so that the socket contact 2 is engaged with the interior of the socket housing 3 and retained therein.

The engaging piece 27 of the socket contact 2 is connected to the engaging plate 24 at the proximal end 27*a*, and is inclined linearly from the proximal end 27*a* to the distal end 27*b*. The distal end 27*b* of the engaging piece 27 projects from the socket contact body 10 provided with the engaging plate 24 thereon in the direction perpendicular to the extending direction of the engaging plate 24. The engaging piece 27 includes an inner surface 27*n* opposing to the engaging plate 24, and an outer surface 27*m* extending in parallel with the inner surface 27*n* and opposing to the inner wall 31*a* of the socket housing 3. The distal end 27*b* of the engaging piece 27 is formed with a distal end surface 27*f* for connecting the inner surface 27*n* and the outer surface 27*m* at one end of the inner surface 27*n* and the outer surface 27*m*.

A pair of opposing side edges of the distal end surface 27*f* correspond to an outer edge 27*v* which comes into contact with the outer surface 27*m* and the inner edge 27*u* which comes into contact with the inner surface 27*n*. In the invention, the inner edge 27*u* is chamfered.

Figure 5A:
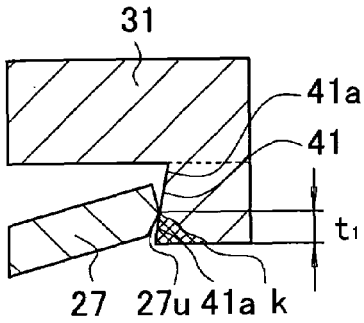
Figure 5B:
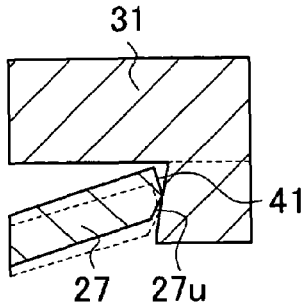
Figure 5C:
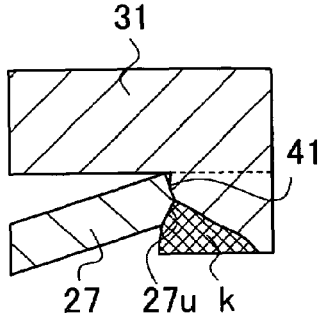
Figure 6A:
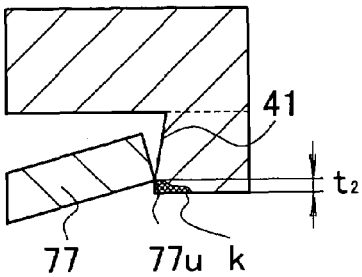
FIGS. 6A and 6B show a state of engagement of the engaging piece in the related art.
Figure 6B:
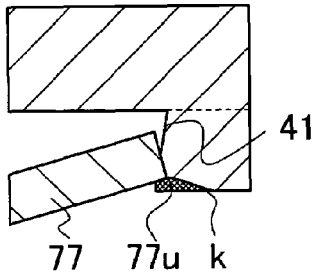

FIGS. 5A~C are drawings for explaining the state of engagement between the engaging piece 27 and the shoulder 41 of the invention. FIGS. 6A and 6B show an engagement structure of an engaging piece 77 in the related art, in which an inner edge 77*u* is not chamfered.

As shown in FIG. 5A, the distance from a point at which the engaging piece 27 according to the invention comes into contact with the inclined surface of the shoulder 41 to the distal end 41*b* of the shoulder 41 is $t_1$. On the other hand, the distance from the point at which the engaging piece 77 which is not chamfered in the related art comes into contact with the inclined surface of the shoulder 41 to the distal end 41*b* of the shoulder 41 is $t_2$, and $t_1$ is smaller than $t_2$.

In other words, when the engaging pieces 27, 77 are at the same level, the engaging piece 27 of the invention is engaged with the shoulder 41 at a position close to the proximal end 41*a* of the shoulder 41 with respect to the unchamfered engaging piece 77, high retaining power is achieved. The chamfered inner edge 27*u* can move smoothly along the shoulder 41 as shown in FIG. 5B, and lifting of the engaging piece 27 can be achieved easily, whereby the engaging force is enhanced.

When the socket contact 2 is pulled toward the rear end 3*b* of the socket housing (right side in FIG. 5A), the engaging piece 27 of the invention is retained in the area shown by k of the engaging protrusion 42. The more the position where the engaging piece 27 is retained is close to the proximal end 41*a* of the shoulder 41, the larger the area of the engaging protrusion 42 which retains the engaging piece 27 becomes, as shown by FIGS. 5A~6B.

In this manner, according to the invention, the engaged area between the shoulder 41 and the engaging piece 27 increases to improve the engaging force by chamfering the inner edge 27*u* of the distal end 27*a* of the engaging piece 27. Therefore, according to the invention, the engaging piece 27 can be inclined linearly from the proximal end 27*a* to the distal end 27*b* without bending the engaging piece 27, whereby the engaging piece 27 is downsized and the retaining force is enhanced.

According to the invention, since the inner edge 27*u* of the distal end of the engaging piece 27 is not angulated, the engaging piece 27 formed of a hard metal plate is prevented from chipping out the shoulder 41. Therefore, the engaging protrusion 42 is prevented form being chipped off and trivialized, and deterioration of the retaining force can be prevented. Also, chips generated when the shoulder 41 is chipped out can be prevented from being attached to the contact plate 22, whereby the contact failure with respect to the opposite contact can be prevented.

In the present embodiment, the chamfering shape of the inner edge 27*u* of the distal end 27*a* of the engaging piece 27 is a inclined surface inclining with respect to the inner surface 27*n* at about an angle of 45°, the chamfering shape is not limited thereto.

Figure 7A:
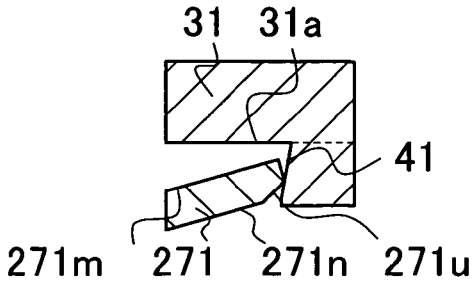
FIGS. 7A~7D show examples of the chamfered shape of the inner edge of the engaging piece according to the invention, in which FIG. 7 A is an example in which the width of the chamfer on the inner surface side is large.
Figure 7B:
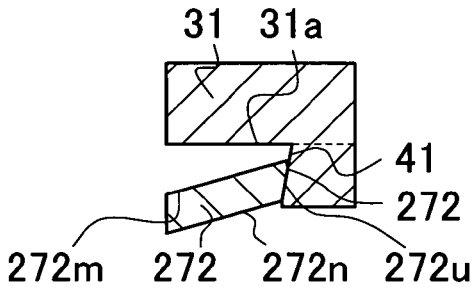
Figure 7C:
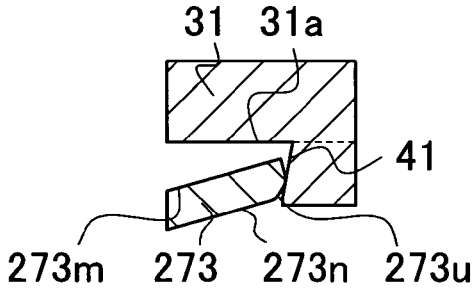
Figure 7D:
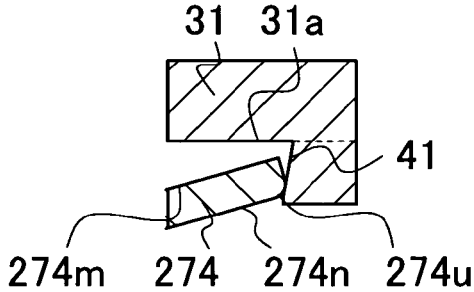

FIGS. 7A~D show examples of the chamfering shapes other than the present embodiment. The shape of the chamfer may be such that an inner surface 271*n* side is removed much as shown in FIG. 7A, for example, and in contrast, as shown in FIG. 7B, it may be such that an distal end surface 272*f* side is removed much so that the chamfered width on an inner surface 272*n* side is unequal to that on the distal end surface 272*f* side. Alternatively, it may be chamfered so as to form a curve as shown in FIGS. 7C and 7D instead of linear plane as in the present embodiment.

Figure 8A:
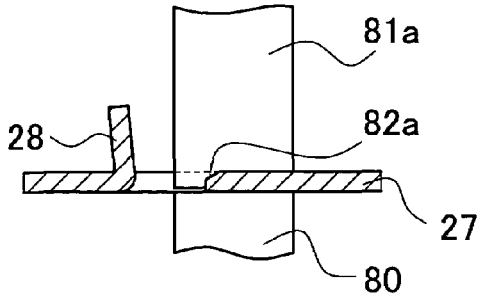

The chamfering as described above can be performed by swaging method using a die and a punch. FIGS. 8A~F are explanatory drawings showing a method of chamfering the inner end of the distal end of the engaging piece. FIG. 8A is an explanatory drawing showing a machining method for forming the inner edge 27*u* shown in FIG. 4B.

As shown in FIG. 8A, the metal plate as the engaging piece 27 is clamped between a die 80 and a punch 81. The punch 81 includes a chamfering portion 82, and when the punch 81 is pressed against the die 80, the portion of the metal plate where the chamfering portion 82 abuts is chamfered. The metal plate is bent when a punch 81*e* is moved toward a die 80*e* so that the engaging piece 27 is lifted upward as shown in FIG. 8E.

Figure 8B:
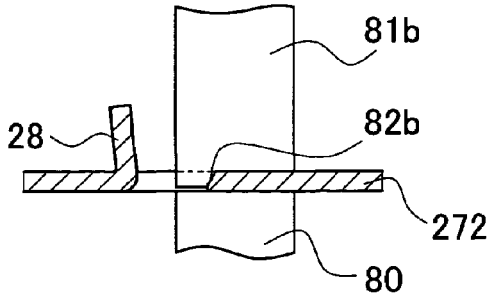
Figure 8C:
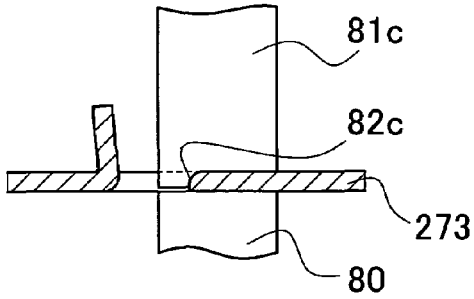
Figure 8D:
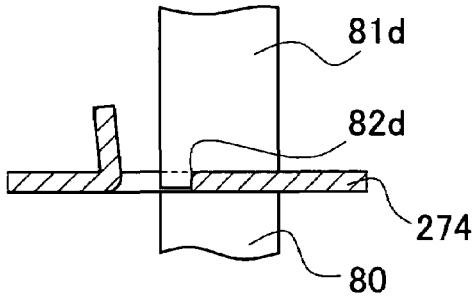
Figure 8E:
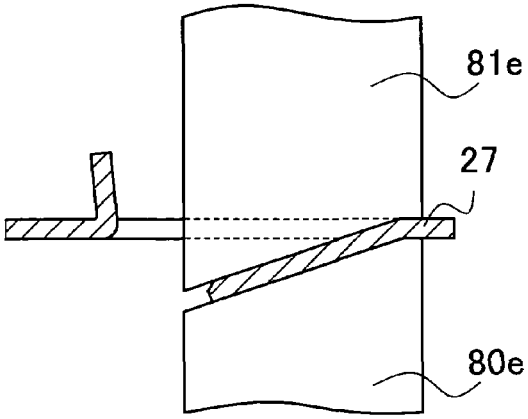

The shape of chamfering of the engaging piece 27 can be changed freely by changing the shape of chamfering portions 82*a*-82*d* of the punch 81 as shown in FIG. 8B, 8C and 8D and, for example, the chamfered shapes as shown in FIGS. 7B, 7C, and 7D are achieved.

Figure 8F:
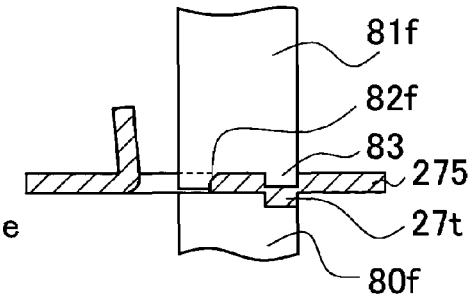

It is also possible to provide a retaining portion 83 on the punch 81 as shown in FIG. 8F. The retaining portion 83 comes into abutment with the portion which corresponds to the midsection of an engaging piece 275, and when the punch 81 is pressed, the engaging piece 275 is formed with a projected portion 27*t* which projects along the direction in which the engaging piece 275 is lifted. The retaining portion 83 of the punch 81 is capable of fixing the engaging piece 275 and chamfering a predetermined position.

Figure 9:
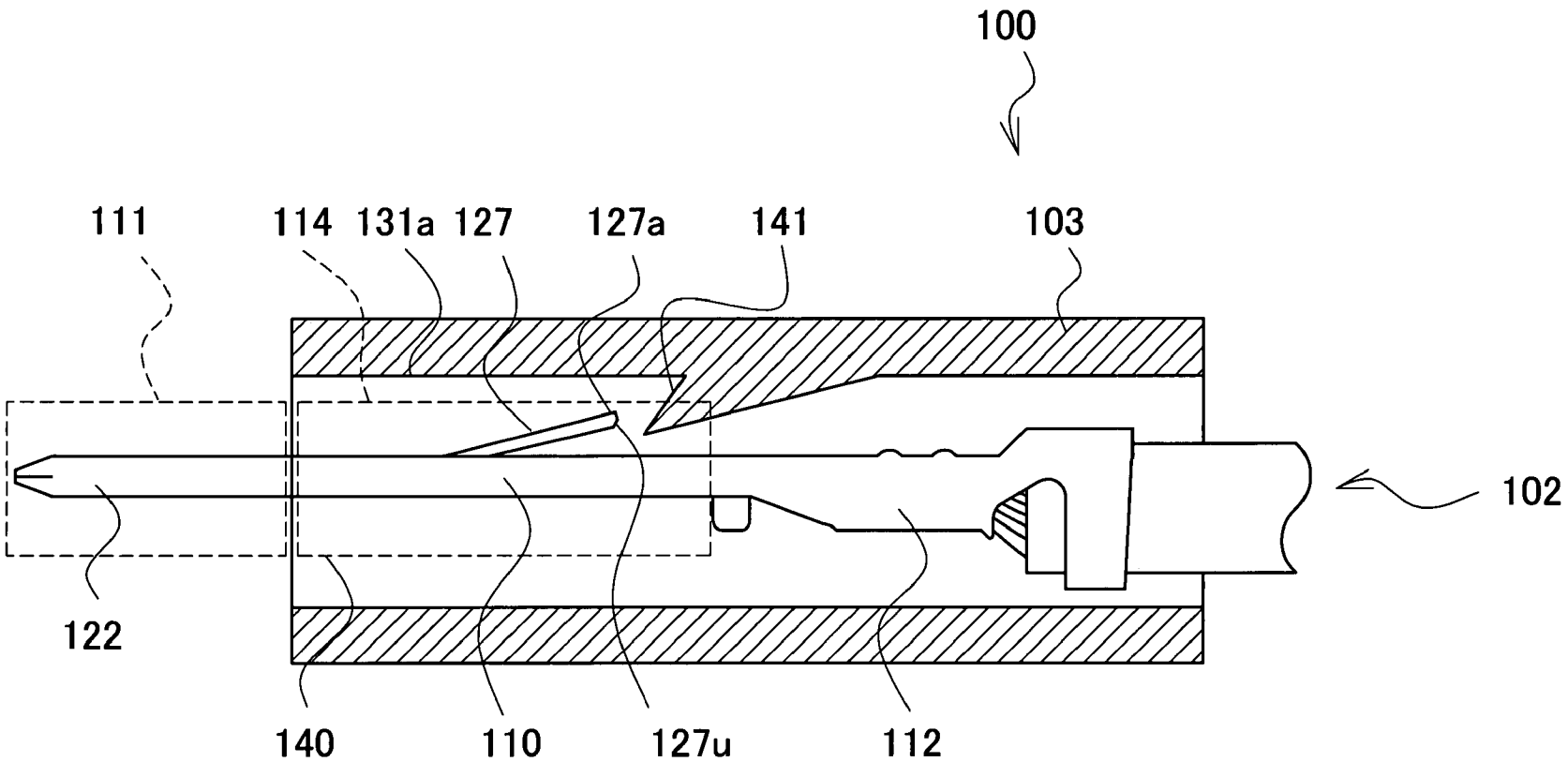
FIG. 9 is a schematic diagram showing a state of engagement between the contact and the socket housing in a tab type connector according to a second embodiment of the invention.

FIG. 9 is a drawing showing a state in which a connector of tab type (hereinafter referred to as "tab type connector") 100 according to a second embodiment of the invention is inserted into a housing for connector of tab type (hereinafter referred to as "tab type housing") 103. The tab type connector 100 includes a contact of tab type (hereinafter, referred to as "tab type contact") 102, and the tab type housing 103. The tab type contact 102 includes an electric cable 113, and a tab type contact body 110 connected to the electric cable 113.

The tab type contact body 110 is formed by cutting out and bending a sheet of titan-copper metal plate, which is capable of used under the high temperature conditions in the order of 100 to 200° C. The tab type contact body 110 includes a contact portion 111 having a contact plate 122, a crimp terminating portion 112 for crimp terminating and retaining the electric cable 113, and an engaging portion 114 provided between the contact portion 111 and the crimp terminating portion 112. The engaging portion 114 is formed with an engaging piece 127, and an inner edge 127*u* of a distal end 127*b* of the engaging piece 127 is chamfered.

On the other hand, the tab type housing 103 is formed with a storage chamber 140 for receiving the tab type contact body 110 inserted therein, and an inner wall 131*a* of the storage chamber 140 is formed with an inverted tapered shoulder 141. The tab type contact 102 and the tab type housing 103 have a structure to be engaged by the engaging piece 127 and the shoulder 141.

According to the invention, by forming the shoulder provided on the inner wall of the housing into an inverted tapered shape in order to engage the engaging piece of the contact, a smooth lifting of the engaging piece is enabled, and the area between the engaging piece and the shoulder can be increased. Therefore, the projecting height of the shoulder from the inner wall can be reduced and the force required for inserting the contact into the housing can be reduced while preventing deterioration of the retaining force.

Also, by chamfering the inner edge of the distal end of the contact engaging piece, a multiplier effect is obtained together with the shoulder of inverted tapered shape, whereby the retaining force can be improved significantly. For example, the retaining force of the engagement mechanism between the engaging piece of the invention whereof the inner edge of the distal end of the engaging piece is chamfered and the shoulder in the related art, which is not inclined in inverted tapered shape is about 90 N. In contrast, with the engagement structure between the inverted tapered shoulder and the engaging piece whereof the inner edge of the distal end is chamfered, the retaining force as much as about 117 N is obtained.

The invention includes a contact body and a housing for storing the contact body, and can be used for a connector for connecting electronic equipment.

What is claimed is:

1. A connector comprising:

a housing having an inside wall which is formed with a first wall, a second wall, and a pair of side walls, the inside wall including a shoulder;

a contact body stored in the housing and connected to an electric cable, the contact body having a contact portion which comes into contact with a contact of an opposing connector, a crimping portion for crimping the end of the electric cable, and an engaging portion provided between the crimping portion and the contact portion;

an engaging plate provided in the engaging portion extending in parallel with the direction of insertion of the contact body;

an engaging piece provided in the engaging portion, which is capable of elastic deformation, and inclined from a proximal end to a distal end of the engaging plate, the engaging piece including a chamfered inner edge at a distal end; and a projection provided on the engaging plate, so as to maintain the engaging piece in a state of being lifted from the contact body, wherein the shoulder is inclined from the proximal end to the distal end of the inside wall so as to engage the engaging piece.

2. A connector according to claim 1, wherein the connector fits into the opposite connector by being inserted into the first end of the housing.

3. A connector according to claim 1, wherein the contact body is formed of a titan-copper plate containing titan and copper.

4. A connector according to claim 1, wherein the housing is formed of a polyphenylene sulfide resin containing glass.

5. A connector according to claim 1, wherein the shape of the chamfered inner edge is such that an inner surface side is removed more than a distal end surface.

6. A connector according to claim 1, wherein the shape of the chamfered inner edge is such that an inner surface side is removed less than a distal end surface.

7. A connector according to claim 1, wherein the shape of the chamfered inner edge is such that an inner surface side is removed more than a distal end surface in a curve.

8. A connector according to claim 1, wherein the shape of the chamfered inner edge is such that an inner surface side is removed less than a distal end surface in a curve.

9. A connector according to claim 1, wherein the engaging piece is provided with a projected portion at a midsection between the proximal end and the distal end of the engaging plate so as to project in the direction of lifting of the engaging piece.

10. A connector according to claim 9, wherein the engaging portion consists of a metal plate;

the engaging portion further including two parallel notches which are substantially parallel with the direction of the length of the contact body, a vertical notch which is orthogonal to the parallel notches and connects between the parallel notches, and a vertical wall;

the vertical wall is formed from the side of the metal plate on which the crimping portion is provided, being bounded by the vertical notch, and bent substantially at a right angle toward the opposite direction from the lifting direction of the engaging piece;

the engaging piece is formed from the side of the metal plate on which the contact portion is provided, including a chamfered inner edge and a projected portion formed by pressing a chamfering portion and a retaining portion of a punch, the engaging piece being bounded by the vertical notch and bent upward so as to project from the contact body.

11. A connector according to claim 10, wherein the engaging plate includes a substantially rectangular shaped hole between the engaging piece and the vertical wall, a pair of projections is formed at positions on each side edges formed by two opposing parallel notches.

12. A connector according to claim 11, wherein the contact body is formed of a titan-copper plate containing titan and copper.

13. A connector according to claim 1, wherein the engaging portion consists of a metal plate;

the engaging portion further including: two parallel notches which are substantially parallel with the direction of the length of the contact body, a vertical notch which is between and orthogonal to the parallel notches, and a vertical wall;

the vertical wall is formed from the side of the metal plate on which the crimping portion is provided, being bounded by the vertical notch, and bent substantially at a right angle toward the opposite direction from the lifting direction of the engaging piece;

the engaging piece is formed from the side of the metal plate on which the contact portion is provided, including a chamfered inner edge formed by pressing a chamfering portion of a punch, the engaging piece being bounded by the vertical notch and bent upward so as to project from the contact body.

14. A connector according to claim 13, wherein the engaging plate includes a substantially rectangular shaped hole between the engaging piece and the vertical wall, a pair of projections are provided at positions on each side edges formed by two opposing parallel notches.

15. A connector according to claim 14, wherein the contact body is formed of a titan-copper plate containing titan and copper.

16. A connector according to claim 1, wherein the contact portion including a contact plate which comes into contact with the contact of the opposite connector, and the contact plate comes into contact with the contact of the opposite connector by being press-fitted into the opposing contact.

17. A connector according to claim 16, wherein the contact portion further includes a contact spring opposing the contact plate, and a side wall connecting the contact spring and the contact plate; and an insertion port for press-fitting the contact of the opposing contact is formed between the contact plate and the contact spring.

18. A connector according to claim 16, wherein the contact plate is provided with a portion which is slightly detached from the housing.

19. A connector according to claim 17, wherein the contact plate is provided with a portion which is slightly detached away from the housing.

* * * * *